US006729101B2

(12) United States Patent
Macri

(10) Patent No.: US 6,729,101 B2
(45) Date of Patent: May 4, 2004

(54) ADJUSTABLE ROOFING BRACKET

(76) Inventor: Joseph Macri, 307 Matthew St., Rome, NY (US) 13440

( * ) Notice: Subject to any disclaimer, the term of this patent is extended or adjusted under 35 U.S.C. 154(b) by 60 days.

(21) Appl. No.: 10/265,482

(22) Filed: Oct. 7, 2002

(65) Prior Publication Data

US 2003/0042377 A1 Mar. 6, 2003

(51) Int. Cl.[7] ..... E04G 3/12

(52) U.S. Cl. ..... 52/749.12; 248/237; 248/148; 182/45

(58) Field of Search ..... 52/749.12, 713, 52/714, 715, 699; 248/237, 238, 148; 182/45, 107, 117, 121, 214

(56) References Cited

U.S. PATENT DOCUMENTS 1,495,868 A * 5/1924 Nielsen ..... 248/237
1,592,384 A * 7/1926 Peck ..... 248/237
1,599,209 A * 9/1926 Cashman ..... 248/237
1,917,809 A * 7/1933 Reimann ..... 248/237
2,496,556 A * 2/1950 Nelson ..... 248/237
2,888,225 A * 5/1959 McQuin ..... 248/237
4,884,775 A * 12/1989 Fischer, Jr. ..... 248/237
5,918,439 A * 7/1999 Metzer et al. ..... 52/748.1
6,045,102 A * 4/2000 Terenzoni ..... 248/238

* cited by examiner

*Primary Examiner*—Carl D. Friedman
*Assistant Examiner*—Basil Katcheves
(74) *Attorney, Agent, or Firm*—David Giglio

(57) ABSTRACT

There is provide an adjustable roofing bracket having a base, a platform support and a rotating brace. The base includes a frontal portion and a rear portion. Opposing sidewalls extend upwardly from the rear portion of the base. A plurality of angular channels are disposed in the sidewalls. The platform support is rotationally mounted to the opposing sidewalls. The rotating brace is rotationally mounted at its top to the platform support. Near its bottom the rotating brace is adapted to cooperate with angular channels. Therefore, to adust the angle of the platform support with respect to the base, the roofer merely chooses which angular channels in which to set the rotating brace. A strike plate contiguous with a backwall of the base provide a surface which a roofer strikes to remove the bracket after use. A gusset disposed between the inner surface of the backwall and the rear portion of the base absorbs and transfers the force away from critical areas of the roofing bracket.

20 Claims, 9 Drawing Sheets

ADJUSTABLE ROOFING BRACKET

FIELD OF THE INVENTION

The present invention relates generally to an apparatus for assisting a roofer performing work on a roof, and, more particularly to an adjustable roofing bracket which is secured to a roof and supports a platform so that the roofer can work off of the platform.

BACKGROUND OF THE INVENTION

Adjustable roofing brackets are known to roofers. An example of a commercially available roofing bracket is shown in FIG. 1. The adjustable roofing bracket of FIG. 1 is flimsy and oftentimes used once or twice and then discarded. Furthermore, to remove this roofing bracket from a roof, a roofer must lift up on a shingle and physically remove the supporting nails. This often causes damages to some shingles.

OBJECTS AND SUMMARY OF THE PRESENT INVENTION

It is therefore and object of the present invention to improve the art of adjustable roofing brackets.

It is a further object of the present invention to provide an adjustable roofing bracket that is safer than the adjustable roofing bracket of the prior art.

It is still a further object of the present invention to provide a roofing bracket that is more durable than the adjustable roofing brackets of the prior art.

These and other objects are provided in accordance with a preferred embodiment of the present invention in which there is provided an adjustable roofing bracket having a base, a platform support and a rotating brace. The base includes a frontal portion and a rear portion. Opposing sidewalls extend upwardly from the rear portion of the base. A plurality of angular channels are disposed in the sidewalls. The platform support is rotationally mounted to the opposing sidewalls. The rotating brace is rotationally mounted at its top to the platform support.

Near its bottom the rotating brace is adapted to cooperate with the angular channels. Therefore, to adust the angle of the platform support with respect to the base, the roofer merely chooses which angular channels in which to set the rotating brace.

A strike plate contiguous with a backwall of the base provide a surface which a roofer strikes to remove the bracket after use. A gusset disposed between the inner surface of the backwall and the rear portion of the base absorbs and transfers the force away from critical areas of the roofing bracket.

BRIEF DESCRIPTION OF THE DRAWINGS

Further objects of the present invention will become apparent from the following description of the preferred embodiments with reference to the accompanying drawings, in which.

DETAILED DESCRIPTION OF THE PREFERRED EMBODIMENT

Figure 1:
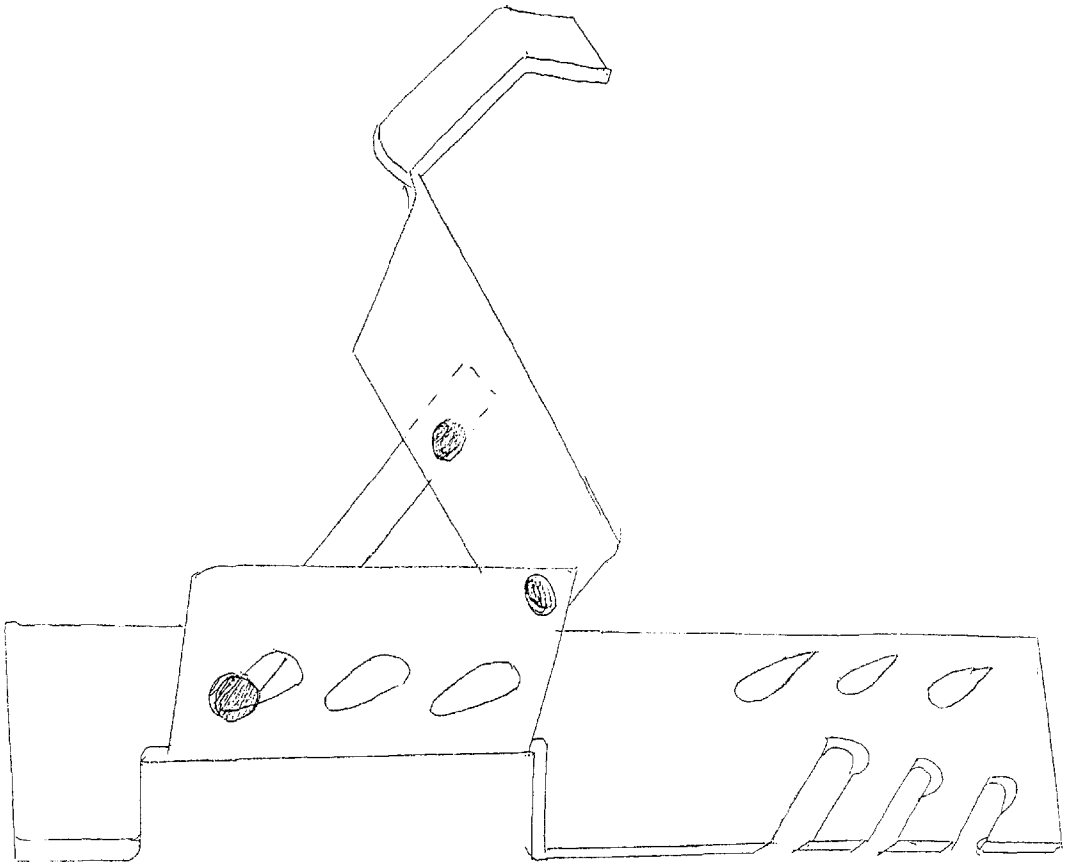
PRIOR ART Fig. 1
FIG. 1 is a perspective view of an adjustable roofing bracket of the prior art.
Figure 2:
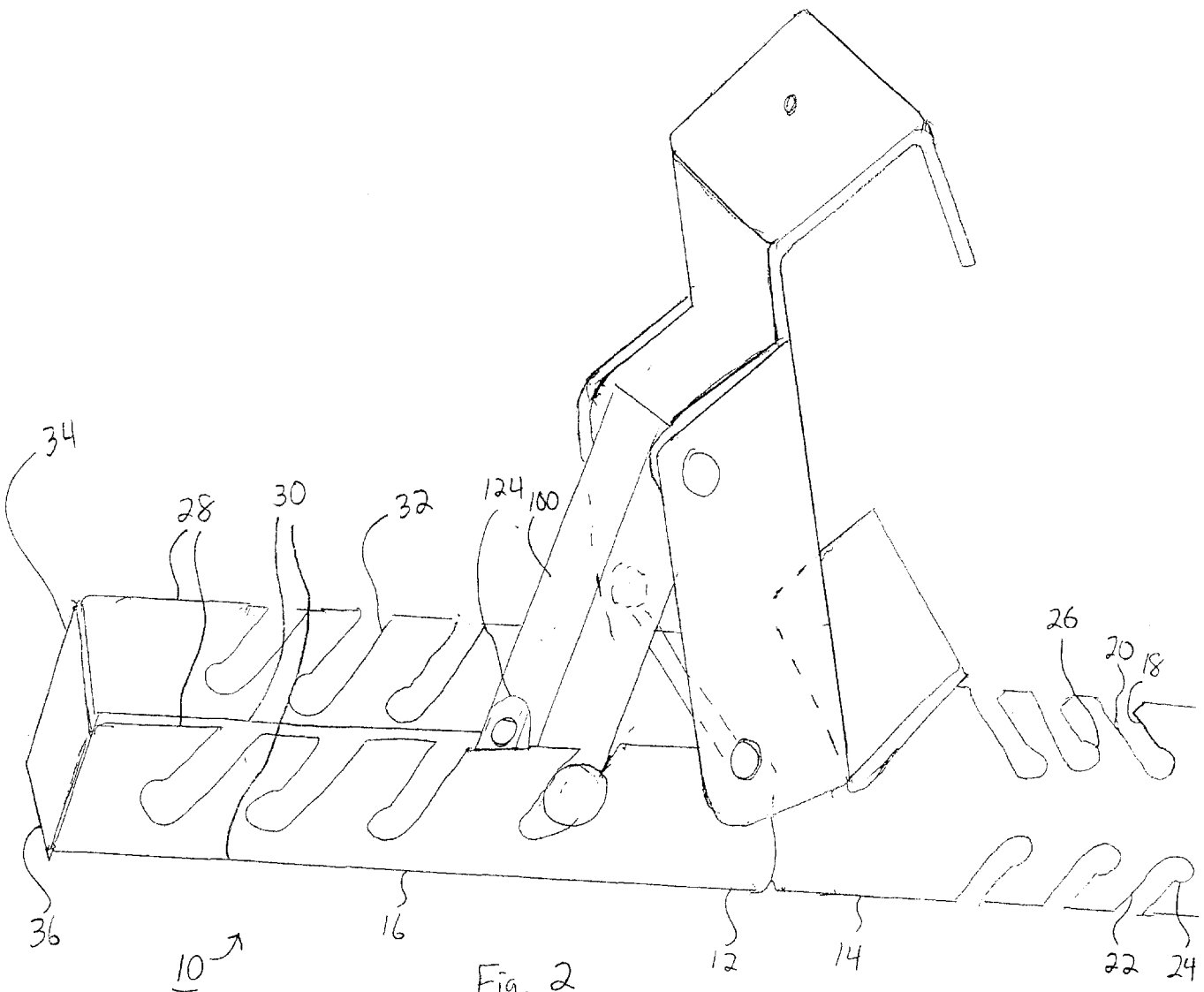
FIG. 2 is a perspective view of an adjustable roofing bracket in accordance with a preferred embodiment of the present invention.

Referring now to FIG. 2 there is shown a roofing bracket 10 in accordance with a preferred embodiment of the present invention. The roofing bracket 10 includes a base 12 having a front portion 14 and a rear portion 16.

The front portion 14 includes nail slots 18 which are known in the art. There are different types of nail slots 18. For ease of understanding the present invention, common channel type nail slots will be briefly described as a roofer would use in accordance with the present invention.

The nail slots 18 begin with channels 20 extending angularly rearward from a side edge 22 of the front portion 14 of the roofing bracket 10. The channels 20 terminate into a partial circular area 24. A roofer drives a nail into the circular area 24 so that the head of the nail lies above the partial circular area 24. At this point the front edge 26 of the circular area 24 butts against the nail shank to properly secure the roofing bracket to the roof.

Moving rearwardly along the base 12, a pair of opposing sidewalls 28 extend upward from opposite sides 30 of the rear portion 16 of the base 12. A plurality of track members 32 are disposed in the opposing sidewalls 28, the function of which shall be described later.

Still moving rearwardly along the base 12 a backwall 34 extends upwardly from the rear 36 end of the rear portion 16. In the preferred embodiment, the backwall 34 is secured to the opposing sidewalls 28, typically by welding.

Figure 3:
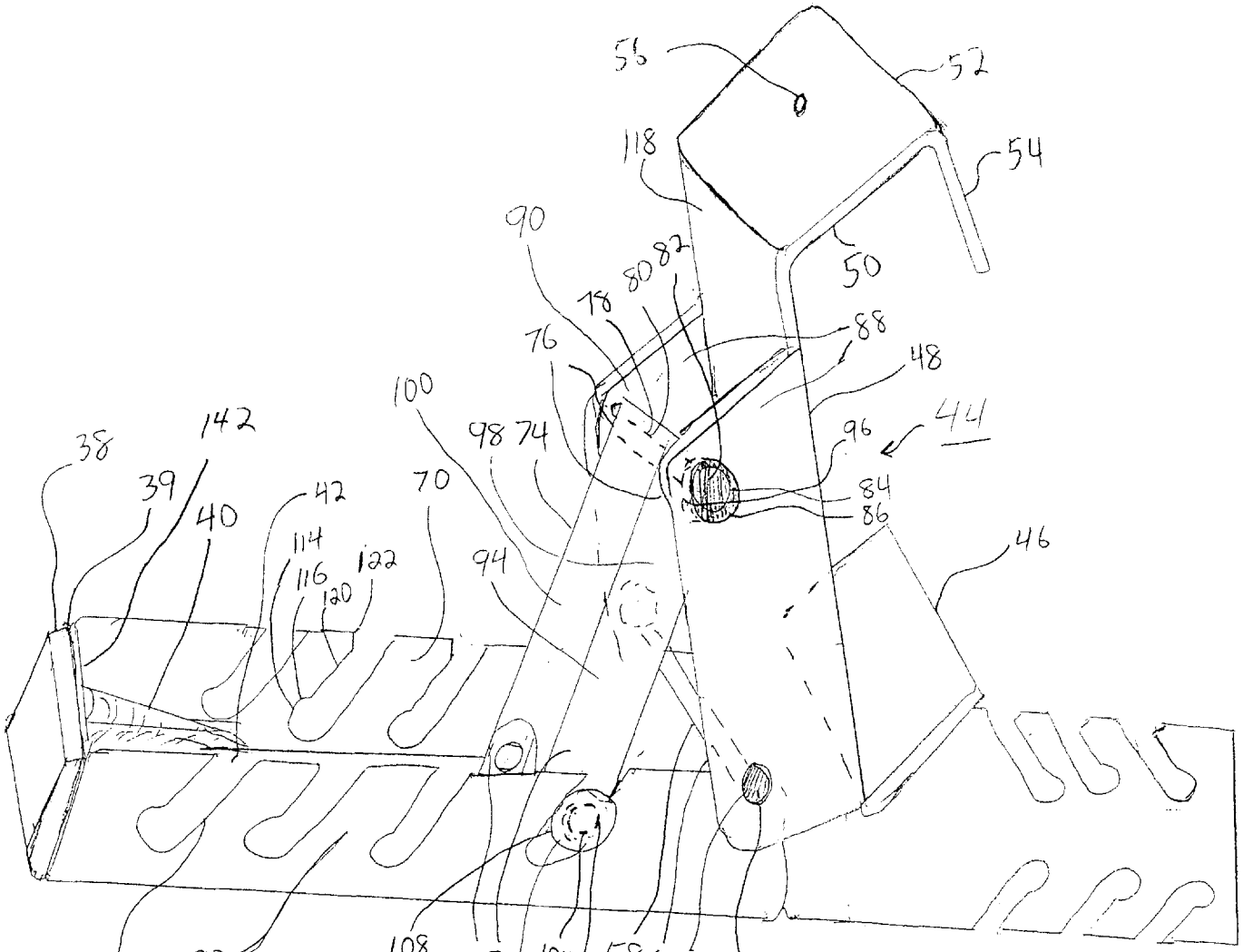
FIG. 3 is a perspective view of the adjustable roofing bracket of FIG. 2 which further depicts the gusset and strike plate.
Figure 4:
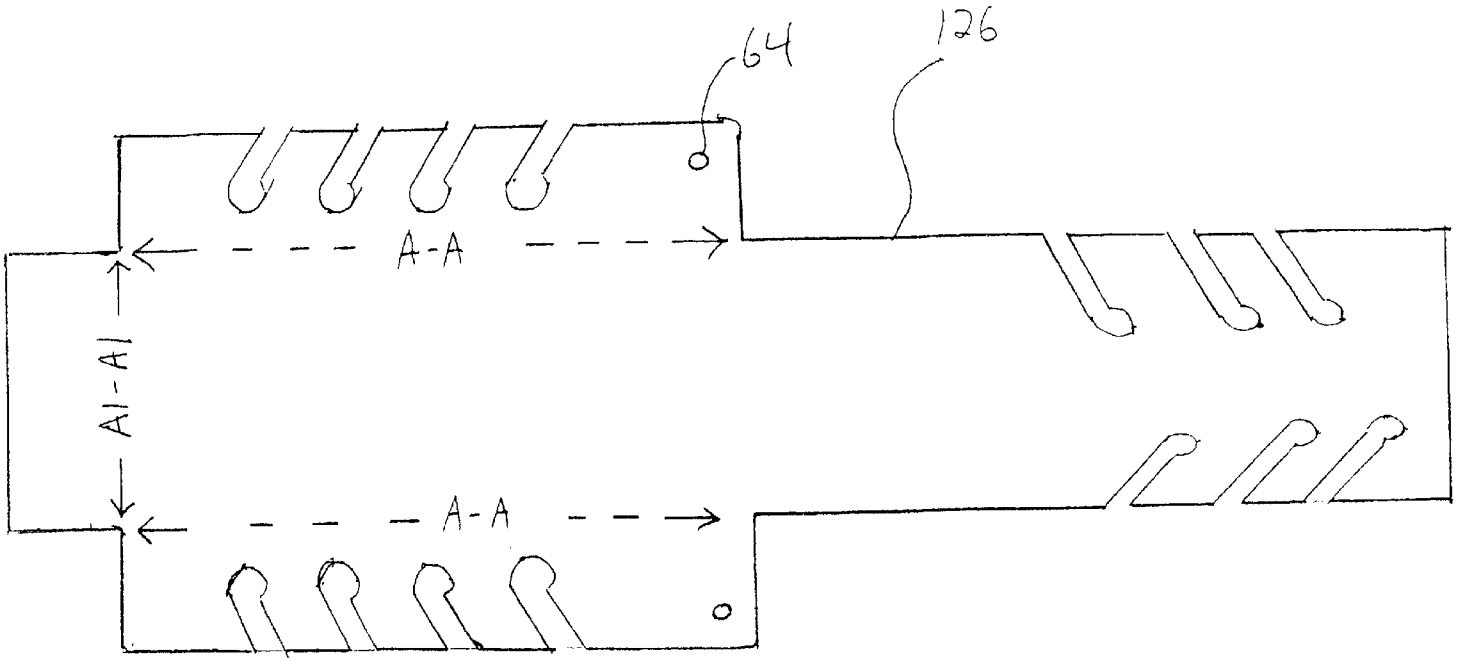
FIG. 4 is a top view of a prebase structure which is used to form the base of the adjustable roofing bracket of FIGS. 2 and 3.

Turning to FIG. 3, a strike plate 38 connected to the backwall 34 allows the roofer to strike the adjustable roofing bracket 10 with a hammer to disengage the nails from the nail slots 18, thereby releasing the roofing bracket 10. Typically the strike plate 38 is welded to the backside 39 of the backwall 34. For ease of striking, the strike plate 38 is of a different color than the backwall 34.

A gusset 40 welded to the backwall 34 and the top 42 of the rear portion 16 of the base 12 absorbs much of the striking force, thereby maintaining the integrity of the roofing bracket 10.

A platform support 44 allows a roofer to extend a board (not shown) between two spaced roofing brackets. The board rests on a bottom lip 46 and against a platform 48. A top lip 50 extending from the top 52 of the platform 48 prevents the board from jumping over the top 50 of the platform 48. An overlip 54 extends downwardly from the top lip 50 and prevents the board from falling over frontward. For added board stability, an opening 56 disposed through the top lip 50 allows the roofer to drive a nail into the board, thereby preventing the board from sliding sideways.

A crossbar 58 having a first diameter 60 and a second diameter 62 is mounted through openings 64 in the opposing sidewalls 28 of the base 12 and through openings 66 in a pair of opposing lower shoulders 68 that extend rearwardly from the platform 48. The smaller first diameter 60 fits snugly through both sets of the openings 64, 66, thereby allowing the platform support 44 to rotate with respect to the base 12. This rotation is important because it allows the roofer to change the angle of the board with respect to the roof. In one example the adjustable bracket 10 can be set for roof pitches of 5/12, 9/12, 12/12 and 20/12.

The larger second diameter 62 of the crossbar 58, which is sized larger than the openings in the opposing sidewalls 28, fit up tightly against inner walls 70 of the opposing sidewalls 28. The tight fit prevents the opposing sidewalls 28 from collapsing inward. The crossbar 58 is welded to outer walls 72 of the lower shoulder 68 of the platform support 44.

It should be noted that many other mounting techniques should be readily apparent to one skilled in the art. For example, a pin can be welded through each pair of openings to allow the platform support 44 to rotate with respect to the base 12. Also, nuts bolts and washers can also give such a rotational effect.

A rotating brace 74 rotationally mounted to a pair of upper shoulders 76 of the platform support 44 allows the angle of the platform support 44 to be adjusted while supporting the load of the board, equipment and personnel.

Once again a crossbar 78 having a smaller diameter 80 and a larger diameter 82 is mounted through openings 84 in the upper shoulders 76 of the rotating brace 74 and openings 86 in opposing upper shoulders 88 of the platform support 44.

In the preferred embodiment, inner walls 90 of upper and lower shoulders 68, 88 are separated by a distance that is substantially the same but slightly larger than the distance between the outer walls 92 of the opposing sidewalls 28 of the base 12. Outer walls 94 of the upper shoulders 76 of the rotating brace 74 are separated by a distance that is substantially the same as the distance between inner walls 70 of the opposing sidewalls 28 of the base 12. Therefore, a spacer 96 is inserted onto the smaller diameter 80 of the crossbar 78 to cover the distance between the outer wall 94 of the upper shoulder 76 of the rotating brace 74 and the inner wall 90 of the upper shoulder 88 of the platform support 44. Once again, the larger diameter 82 of the crossbar 78 fits against inner walls 98 of the upper shoulders 76 of the rotating brace 74 to prevent inward rotation of the shoulders 76. The upper shoulders 76 of the rotating brace 74 are connected by a back member 100. The back member 100 provides structural integrity to the rotating brace 74 as it keeps the shoulders 76 properly aligned. It should be apparent to one skilled in the art that many modifications can be made to the shape of the back member 100 without departing from the spirit and scope of the present invention.

Extending from the back member 100 a pair of opposing leg members 102 include openings 104 each having a pin 106 extending outwardly therethrough. The pin 106 includes a head 108 and a shaft 110 and is welded to the lower leg members 102.

Turning back to the track members 32 disposed in the opposing sidewalls 28 of the base 12, each track member 32 includes an angular channel 112 running rearwardly and terminating in a partial circular opening 114. In use, the pin shaft 110 slides down the angular channel 112 and lodges in the partial circular opening 114.

A slight frontward rotational force to the platform support 44 does not release the shaft 110 from the circular opening 114 as the shaft 110 butts up against a top portion 116 of the partial circular opening 114. Therefore, the platform support 44 will not collapse forward. To dislodge the shaft 110 from the partial circular opening 114 a sharp strike to the upper backside 118 of the platform support 44 with a hand or tool is required.

An upper rear wall 120 of the angular channel 112 includes a beveled portion 122 which allows the shaft 110 easier ingress and egress to the channel.

Finally in a preferred embodiment, the back member 100 includes a notched portion 124, shown in FIG. 2, at its bottom to allow it to slide freely over the gusset 40 at all angles.

To fabricate the roofing bracket 10 of the present invention, a flat piece of ten gauge ribbon steel is stamped to form a prebase structure 126, shown in FIG. 3. The prebase structure 126 is bent upwardly to ninety degrees at cross-sections A—A to form the opposing sidewalls 28. The prebase structure 126 is further bent upward at A1—A1 to form the back wall 34.

Figure 5:
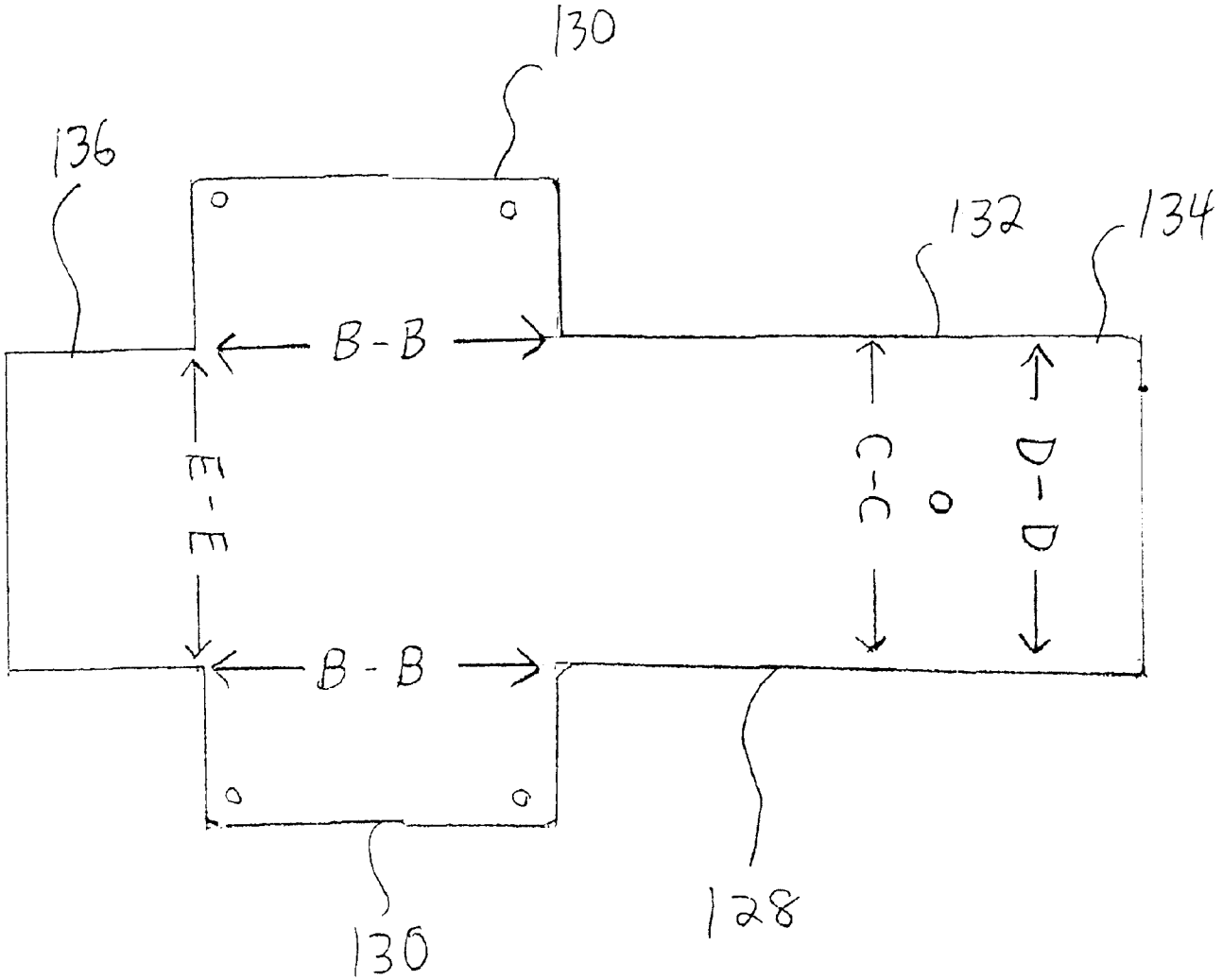
FIG. 5 is a top view of a preplatform support structure which is used to form the platform support of FIGS. 2 and 3.
Figure 6:
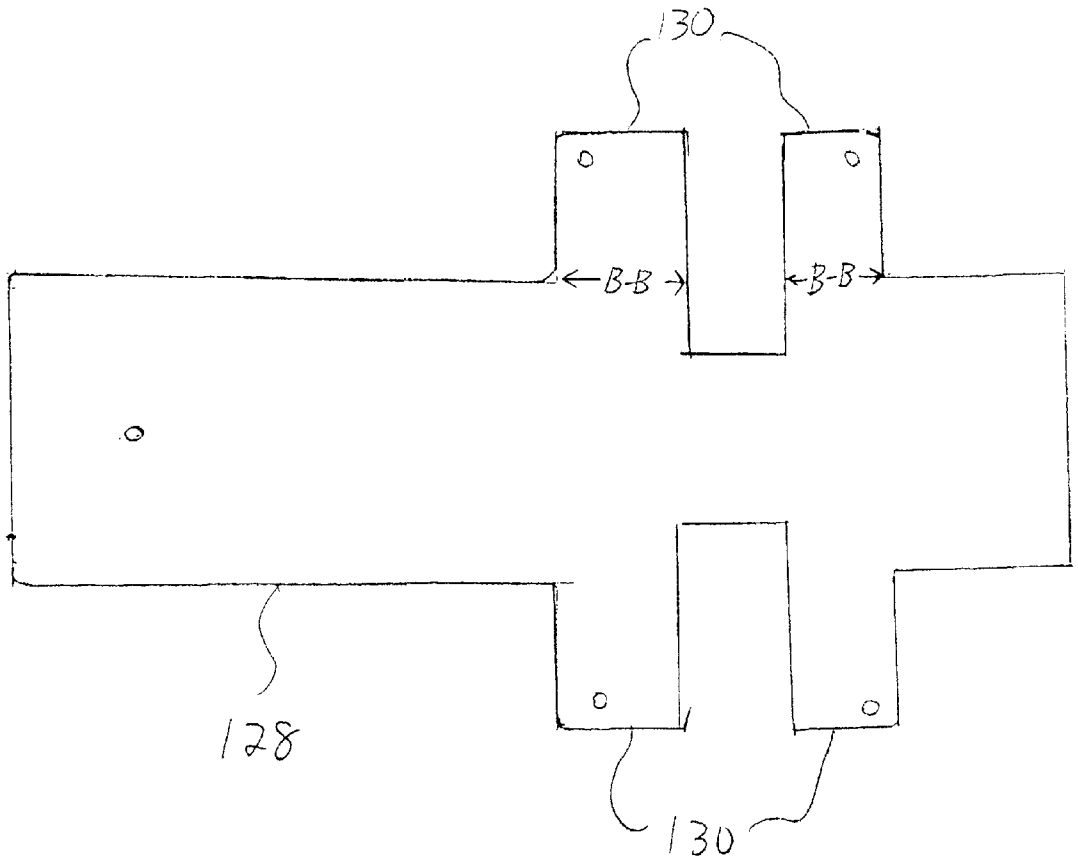
FIG. 6 is a top view of an alternate preplatform support structure which can be used to form the platform support of FIGS. 2 and 3.

A second flat piece of ten gauge ribbon steel is stamped to form a preplatform support structure 128, shown in FIGS. 5 and 6. Opposing outer edges 130 are bent backward to ninety degrees at cross section B—B to form the upper and lower shoulders 68, 88. Next, an upper section 132 is bent forward at cross section C—C to form the top lip 50. A second upper section 134 is bent downward at cross section D—D to form the over lip 54. Finally, a bottom section 136 is bent at cross section E—E to form the bottom lip 46.

Figure 7:
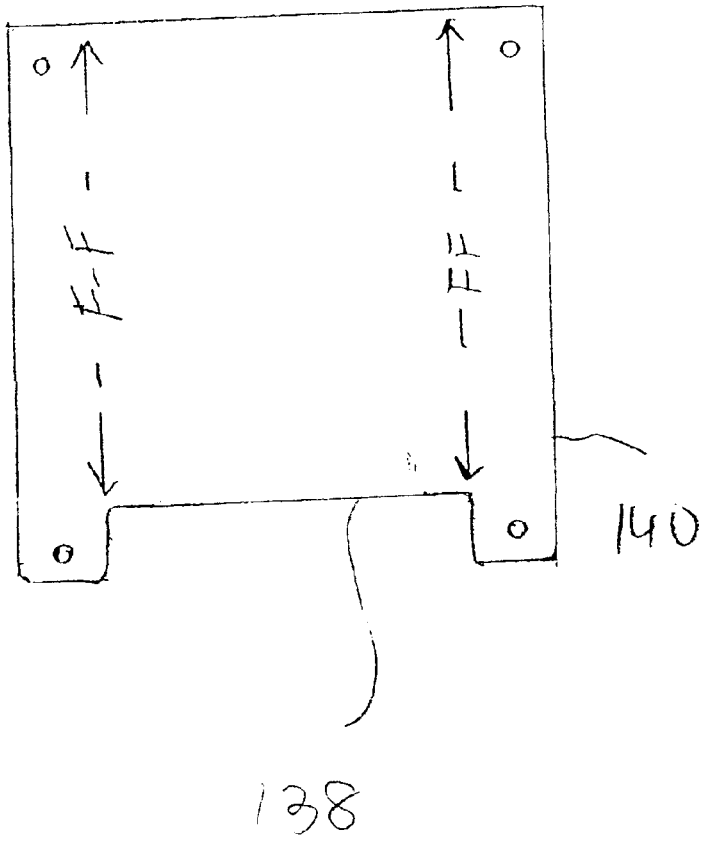
FIG. 7 is a top view of a prebrace structure which is used to form the rotating brace of FIGS. 2 and 3.
Figure 8:
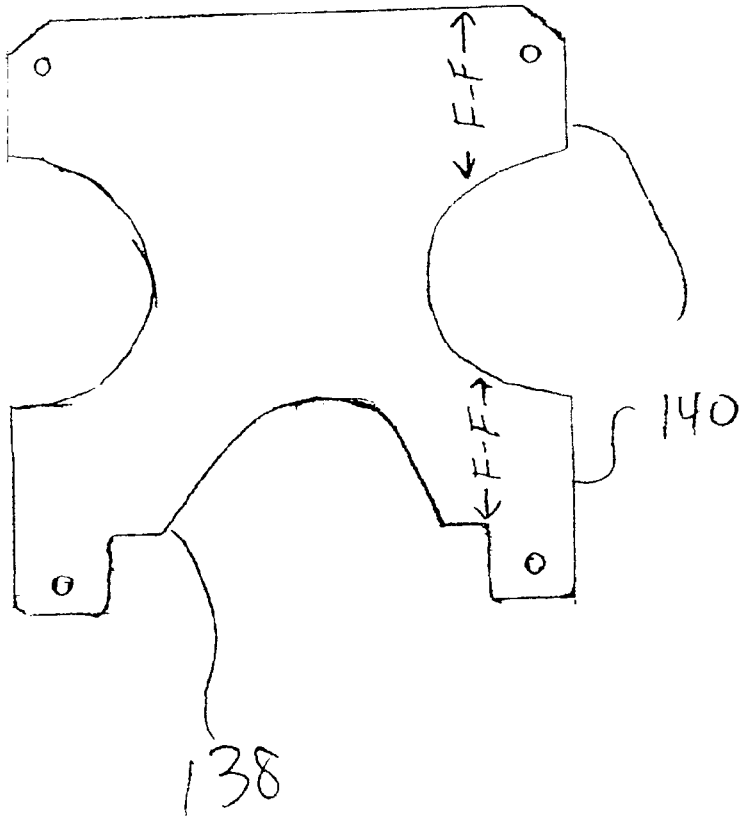
FIG. 8 is a top view of a first alternate prebrace structure which is used to form the rotating brace of FIGS. 2 and 3.
Figure 9:
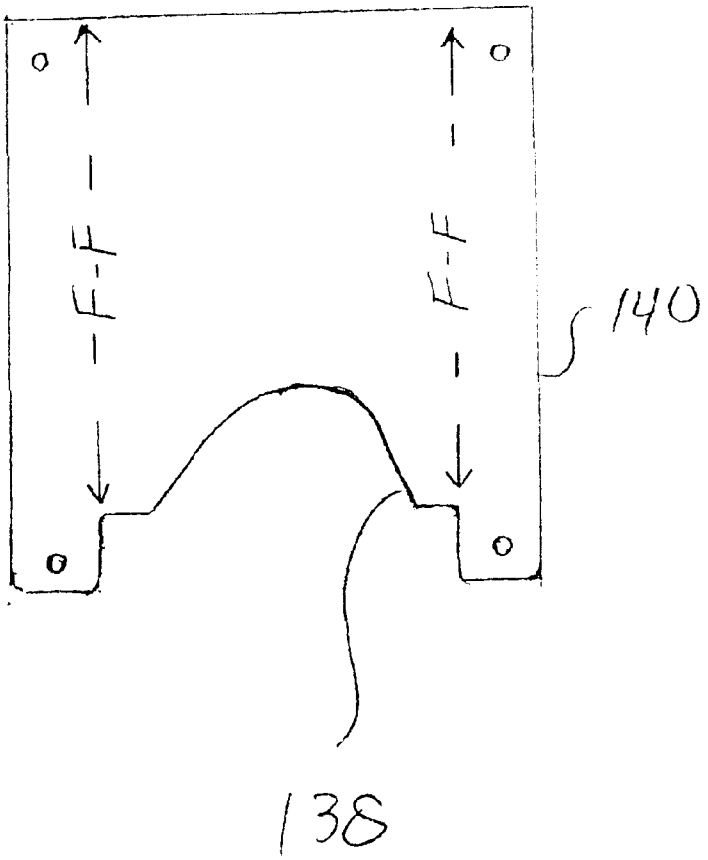
FIG. 9 is a top view of a second alternate prebrace structure which is used to form the rotating brace of FIGS. 2 and 3.

Turning now to FIGS. 7, 8 and 9, the rotating brace 74, a third piece of ribbon steel is stamped to form a prebrace structure 138. Next, outer sections 140 are bent backward at cross sections F—F to form the shoulders 76 and leg members 102 of the rotating brace 74.

The pins 106 are now fastened by riveting and/or welding through the openings 104 in the lower leg members 102. The pins 106 can also connect to each other with a crossbar (not shown).

The rotating brace 74 is rotatably mounted to the upper shoulders 88 of the platform support 44 as previously described. Next, the platform support 44 is rotatably mounted to the base sidewalls 28 also as previously described. It should be apparent to one skilled in the art that other mounting mechanisms and techniques are also suitable.

Now the backwall 34 is welded to the opposing sidewalls 28 to provide a strong base. Next, the gusset 40 is formed and welded to the front 142 of the backwall 34 and to the top 42 of the back portion 16 of the base 12.

Finally, the strike plate 38 is formed from ¼ inch steel and welded to the backside 39 of the backwall 34. The adjustable roofing bracket 10 is now suitable for use.

The angle of the platform 48 with respect to the base 12 is adjustable by fitting the pin shafts 110 into the appropriate track members 32. To remove the roofing bracket 10, the board is removed and then the roofer conveniently strikes the strike plate 38 with his hammer to dislodge the nail slots 18 from the nails.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention as defined in the appended claims.

What is claimed is:

1. An adjustable roofing bracket comprising:

a base having a front portion and a rear portion;

a pair of opposing base sidewalls extending upward from the rear portion of said base;

a plurality of nail slots disposed thru said front portion of said base;

a plurality of opposing track members disposed in said opposing base sidewalls, each of said track members extending from the top of the sidewalls;

a platform support having a platform, a top lip and an overlip for retaining a board;

a pair of opposing upper shoulders extending rearwardly from said platform;

a pair of opposing lower shoulders extending rearwardly from said platform, said opposing lower shoulders rotatably mounted to said opposing sidewalls; and a rotating brace including a back member having a pair of opposing upper shoulders extending therefrom, said pair of opposing upper back member shoulders being rotatably mounted to said opposing pair of upper platform shoulders, said rotating brace adapted to cooperate with said plurality of opposing track members.

2. The Adjustable Roofing Bracket of claim 1 wherein said rotating brace further includes a pair of opposing legs, said opposing legs being adapted to cooperate with said plurality of opposing track member.

3. The Adjustable Roofing Bracket of claim 2 including a backwall extending upwardly from the rear portion of said base.

4. The Adjustable Roofing Bracket of claim 3 wherein said backwall is connected to said opposing sidewalls.

5. The Adjustable Roofing Bracket of claim 3 further including a strike plate contiguous with said backwall.

6. The Adjustable Roofing Bracket of claim 5 wherein said strike plate includes a color that is different than the color of the backwall.

7. The Adjustable Roofing Bracket of claim 5 further including a gusset superimposed over a portion of the rear portion of said base, said gusset being connected to a front portion of said backwall and to said rear portion of said base.

8. The Adjustable Roofing Bracket of claim 7 wherein said back member includes a notched portion from its bottom such that the bottom of said back member fits over the top of said gusset at adjustable positions of said adjustable roofing bracket.

9. The Adjustable Roofing Bracket of claim 1 wherein said platform support further includes a bottom lip extending from said platform.

10. The Adjustable Roofing Bracket of claim 1 wherein said opposing track members include a channel extending angularly downward from the top of said sidewall, said channel including a front wall and a rear wall, said channel terminating in a substantially circular area.

11. The Adjustable Roofing Bracket of claim 10 wherein each of said opposing legs includes a pin extending outwardly therefrom, said pin having a head and a shaft.

12. The Adjustable Roofing Bracket of claim 1 wherein said shaft is sized to fit between the front and rear walls of said channel while said head being sized larger than the distance between the front and rear walls of said channel.

13. The Adjustable Roofing Bracket of claim 1 wherein said front and rear portion have substantially the same continuous width.

14. The Adjustable Roofing Bracket of claim 1 wherein said rotating brace engages said opposing track members at two positions.

15. The Adjustable Roofing Bracket of claim 1 wherein said platform support engages said rotating brace at two positions.

16. An adjustable roofing bracket comprising:

a base having a front portion and a rear portion;

a pair of opposing base sidewalls extending upward from the rear portion of said base;

a plurality of nail slots disposed thru said front portion of said base;

a plurality of opposing track members disposed in said opposing base sidewalls, each of said track members extending from the top of the sidewalls;

a backwall extending upwardly from the rear portion of said base and being connected to said opposing sidewalls, a platform support having a platform, a top lip, a bottom lip and an overlip for retaining a board, a pair of opposing upper shoulders extending rearwardly from said platform, a pair of opposing lower shoulders extending rearwardly from said platform, said opposing lower shoulders rotatably mounted to said opposing sidewalls; and a rotating brace including a back member having a pair of opposing upper shoulders extending therefrom, said pair of opposing upper back member shoulders being rotatably mounted to said opposing pair of upper platform shoulders, said rotating brace further includes a pair of opposing legs being adapted to cooperate with said plurality of opposing track members.

17. The Adjustable Roofing Bracket of claim 16 further including a strike plate contiguous with said backwall.

18. The Adjustable Roofing Bracket of claim 5 further including a gusset superimposed over a portion of the rear portion of said base, said gusset being connected to a front portion of said backwall and to said rear portion of said base.

19. The Adjustable Roofing Bracket of claim 18 wherein said back member includes a notched portion from its bottom such that the bottom of said back member fits over the top of said gusset at adjustable positions of said adjustable roofing bracket.

20. The Adjustable Roofing Bracket of claim 1 wherein said opposing track members include a channel extending angularly downward from the top of said sidewall, said channel including a front wall and a rear wall, said channel terminating in a substantially circular area.

* * * * *